US005472238A

United States Patent [19]

Sato

[11] Patent Number: 5,472,238

[45] Date of Patent: Dec. 5, 1995

[54] PAPER BINDER

[76] Inventor: Hisao Sato, Fujimidai Mansion 2002, 29–10, Nukui, 1-Chome, Nerima-Ku, Tokyo, Japan

[21] Appl. No.: 395,860

[22] Filed: Feb. 28, 1995

[51] Int. Cl.[6] ..... B42D 3/00

[52] U.S. Cl. ..... 281/45; 281/15.1; 281/49; 402/19

[58] Field of Search ..... 281/15.1, 21.1, 281/28, 42, 45, 47, 51; 402/2, 19

[56] References Cited

U.S. PATENT DOCUMENTS

| | | | |
|---|---|---|---|
| 4,243,249 | 1/1981 | Goss | 281/45 X |
| 4,375,296 | 3/1983 | Chang | 281/45 |
| 5,413,430 | 5/1995 | Schrem et al. | 281/45 X |

*Primary Examiner*—Willmon Fridie, Jr.
*Attorney, Agent, or Firm*—Kanesaka & Takeuchi

[57] ABSTRACT

A paper binder which removably secures a large number of pages of paper without injury to the paper, and which conducts binding so that it is easy to leaf through the pages. The paper binder comprises: a rectangular mount; a lever member extending in parallel with one edge of the mount and having one end rotatably supported at a corner portion of the mount; a spring member supported on the mount and having opposite ends one of which is fixed to the lever member so as to urge a free end of the lever member upward elastically; a pressing member attached to the other one of the opposite ends of the spring member so that the pressing member is elastically pressed in the direction toward the mount by an elastic force of the spring member to thereby grip a corner of paper disposed between the pressing member and the mount when the free end of the lever member is pressed downward against the elastic force of the spring member; and a locking member for locking the lever member when the free end of the lever member is pressed downward to maintain the lowered state of the lever member.

9 Claims, 9 Drawing Sheets

PAPER BINDER

BACKGROUND OF THE INVENTION

1. Field of the Invention

The present invention relates to a binder which removably binds from one to several pages, and more particularly relates to a paper binder which conducts retention by elastically pressing down upon the corner portion of the pages to be bound.

2. Description of the Related Art

When collecting and storing comparatively small-sized paper of memos, slips, or the like, wide use is made of a binder called a memo holder or memo binder where a freely pivoting pressing member is provided on one side of a hard mount, and where the free end side of the pressing member constantly is made to press against the mount by means of a spring. With regard to this type of binder, as a user successively receives or produces more memos or slips, the user opens the free end side of the pressing member against the spring force and places these memos or slips on top of the memos or slips already fastened on the mount, releases the force holding open the free end side of the pressing member, and thereby retains the paper by the pressing member. Thus, retention is made possible by an extremely simple operation. In the case where the bound memos or slips are removed from the binder, the user merely has to open the free end side of the pressing member, which is very convenient.

The concept for the pressing and binding of paper in such a manner as mentioned above is not only used for small-sized paper such as memos and slips, but is also used in binders which fasten comparatively large materials and report paper of B5 and A4 size, as well as large pages of copier paper, etc. That is, a pressing means is provided so that the left side area of the paper to be bound is pressed against the rear cover of a cover composed from a front cover, a rear cover, and a back cover. The pressing means is composed from a lever which is supported so that one end is freely movable, and a pressing member which is released when the free end of the lever is lifted, which forms a belt and is elastically pressed to the rear cover side when the free end of the lever is turned so as to make the lever horizontal, and which presses the left side area of the paper to be bound.

With regard to these types of holders or binders, not only it is extremely simple to bind and release paper as explained above, but also since it is also unnecessary to open a hole in the paper for purposes of having a pipe, a string, a band or the like pass through in order to bind the paper, no injury is inflicted on the paper.

The aforementioned holders or binders are preferable from the standpoint of inflicting no injury on the paper, but since one side of the paper is pressed down, it is difficult to leaf through the paper when numbers of pages are bound together. Moreover, in the case of memos or slips, the size varies according to the user and the dimensions of the recorded contents, and unevenness tends to occur. In this context, when the user conducts blanket binding without regard to size, and when the user later looks over these memos or slips, particularly in the case where the user looks at a small memo or slip which is fastened underneath a large memo or slip, the user is not able to see it unless the user leafs through the pages so that the memo or slip which is fastened on top is strongly bent over. Yet, if the bending force becomes stronger than the pressing force of the pressing member, it is no longer possible to press the memos or slips, and the memos or slips fall away from the pressing member.

Furthermore, in the case of comparatively large paper of B5 or A4 size, the elasticity of the paper also becomes larger compared to memos or slips, and a stronger pressing force is required of the pressing means. Yet, if a spring with a large spring elasticity is used in order to obtain a strong pressing force, it also becomes necessary to apply a strong force in turning the lever, and handling becomes difficult.

Additionally, in the case where a large number of pages are bound, the binding portion becomes larger as it goes to the rear, the inconvenience arises that the edge of the opened portion is covered by the binding portion and cannot be seen.

SUMMARY OF THE INVENTION

The object of the present invention is to provide a paper binder wherein a plurality of pages are able to be securely retained without injury to the paper, wherein a user can view all contents recorded on the surface of the paper when the user leafs through the pages, wherein it is easy to leaf through to the end even when there are a large number of pages, and wherein the pages are not dislodged during leafing.

Another object of the present invention is to provide a paper binder which has a simple configuration with a small number of portions, and whose assembly is easy.

In order to attain the above objects, according to an aspect of the present invention, a paper binder comprises: a rectangular mount; a lever means extending in parallel with one edge of the mount and having one end rotatably supported at a corner portion of the mount; a spring means supported on the mount and having opposite ends one of which is fixed to the lever means so as to urge a free end of the lever means upward elastically; a pressing means attached to the other one of the opposite ends of the spring means so that the pressing means is elastically pressed in the direction toward the mount by an elastic force of the spring means to thereby grip a corner of paper disposed between the pressing means and the mount when the free end of the lever means is pressed downward against the elastic force of the spring means; and a locking means for locking the lever means when the free end of the lever means is pressed downward to maintain the lowered state of the lever means.

In the case where paper is bound by a binder configured in this way, first, the lever means whose free end is locked downward by the lock means is released from the lock means. As a result, the free end of the lever member is rotated upward by the elastic force of the spring means, and the elastic pressure toward the mount exerted by the pressing means is eliminated. Here, if a corner of paper is fitted between the mount and the pressing means, if the free end of the lever member is pressed downward, and if the lever member is again locked by the lock means, the pressing means elastically presses against the mount, and the corner of the paper is firmly gripped between the pressing means and the mount. Moreover, since the pressing means contacts the narrow portion at the corner of the paper, even if the paper is bent from this portion, the bounce of the paper generated by the bending is weak, and even if a large number of pages are opened by being bent from their corner, the overall bounce does not become large. Accordingly, it is possible to secure a large number of pages, to turn them over without dislodging any from between the pressing means and the mount, and to keep them firmly secured. Furthermore, since the corner of the pages are normally blank and since it is this portion which is pressed by the pressing means, the user can view the entirety of the contents recorded on the page without any obstruction by the pressing means.

Preferably, the pressing means is composed of a pressing plate member and a fixed plate member, the pressing plate member being made from a metal plate so as to form an approximate right triangle, the pressing plate member having claw means which is formed thereon and a grooved engagement portion which is formed by bending backward a part of the pressing plate member at the hypotenuse of the right triangle so as to form a groove on top, the fixed plate member having one end which is inserted into the groove of the engagement portion of the pressing plate member and the other end which is fixed to the pressing plate member by the claw means, the other end of the spring member being rotatably supported between the fixed plate member and the pressing plate member. By this configuration, the pressing means can be rotatably supported by the other end of the spring means by a simple process where the one end of the fixed plate member is inserted into the groove or engagement portion of the pressing plate member, and the other end of the fixed plate member is fixed to the pressing plate member by bending the claw means which is formed in the pressing plate member.

Alternatively, the pressing means may be made preferably from synthetic resin so as to form an approximate right triangle, the pressing means having a groove formed on its top face so as to rotatably support the other end of the spring member in the groove. By this configuration, the other end of the spring means can be rotatably supported by the pressing means by a very simple process where the other end of the spring member is press fitted into the groove.

Preferably, the lock means includes a projection provided in a rear face of the free end side of the lever means and an engagement portion which engages with the projection so as to regulate raising of the lever means when the lever member is pushed downward. By this configuration, if the free end of the lever means is pressed downward, the projection engages with the engagement portion, and the free end of the lever member can be retained in its lowered position, and when wishing to raise the free end of the lever means, the user can do so by a simple operation where the free end of the lever means is further lowered so as to release the engagement of the projection with the engagement portion, and lifting is conducted while shifting slightly so that the projection and the engagement portion do not engage.

Other further objects and advantages of the present invention will become clear from the explanation of preferred embodiments discussed below.

DESCRIPTION OF THE PREFERRED EMBODIMENTS

Figure 1:
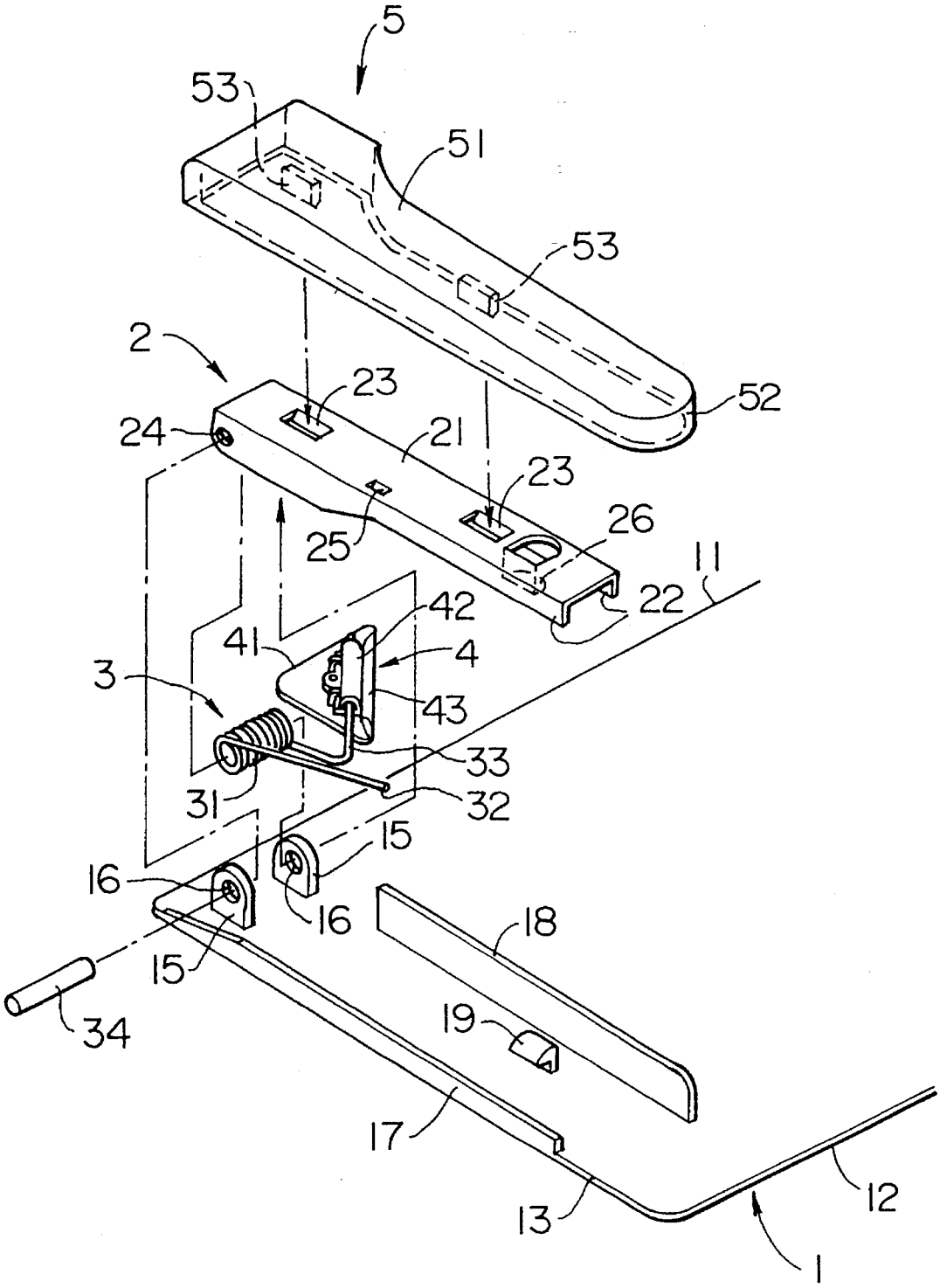
FIG. 1 is a partial perspective view which shows, in a disassembled state, a first embodiment of the paper binder according to the present invention.

Below, the present invention is explained with reference to embodiments illustrated by drawings. Throughout these embodiments, substantially identical constituent elements are given identical reference numerals, and redundant explanations are omitted.

First, a first embodiment shown in FIG. 1 to FIG. 7 is explained. The paper binder comprises a rectangular mount 1 which is made from synthetic resin and on the top of which paper to be bound is mounted, a lever member 2 which is made from a metal plate and one end of which is rotatably supported by the mount 1, a metal spring member 3 which is designed to elastically urge upward the free end of the lever member 2, a pressing means 4 of metal which is attached to one end of the metal spring member 3 and which grips the corner of the paper between the same pressing means 4 and the mount 1 when the free end of the lever member 2 is pressed downward, and a cover member 5 of synthetic resin which is fitted so as to cover the lever member 2.

Figure 2:
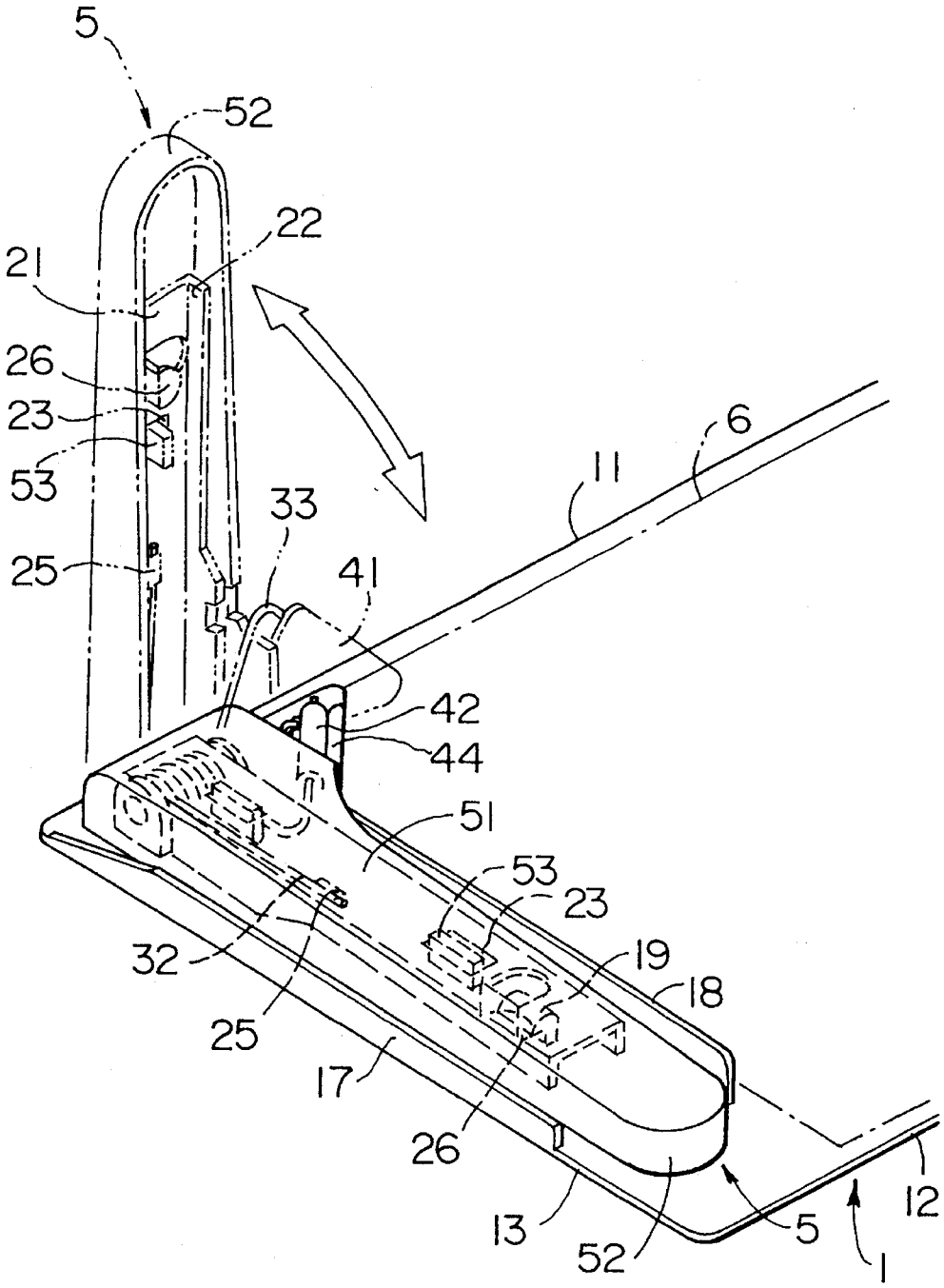
FIG. 2 is a partial perspective view which shows the first embodiment in an assembled state.

As seen in FIGS. 1 and 2, the mount 1 forms a rectangle consisting of four sides of an upper end 11, a lower end 12, a left end 13, and a right end (not illustrated). A support of the lever member 2 is provided at the left end 13 side, and its right side constitutes a flat portion for the placement of paper such as slips, memos ore the like. At the corner formed by the upper end 11 and the left end 13 of the mount 1, a pair of bearing projections 15 are provided integrally with the mount 1 at an interval in the left-to-right direction. Shaft holes 16 are pierced in these bearing projections 15 respectively. A pair of guide projections 17 and 18 are provided on the mount 1 integrally therewith so as to extend in the direction from the upper end 11 toward the lower end 12. The distance between these guide projections 17 and 18 must be at least longer than the maximum width of the cover member 5, and it is preferable that the height of guide projection 18 be set so as to be higher than the maximum thickness of the paper to be bound. On the other hand, the height of guide projection 17 is lower than guide projection 18, but it may also be equal to that of the guide portion 18. An engagement portion 19 of a below-mentioned lock means is provided integrally with the mount 1 between the guide projections 17 and 18. A portion of the mount 1 on the right side of the guide projection 18 constitutes a placement site for paper.

The lever member 2 includes a rectangular top portion 21 and side portions 22 which are respectively bent downward from the two lengthwise ends of the top portion 21. The length of the top portion 21 is shorter than the length between the upper end 11 and the lower end 12 of the mount 1. A pair of nib receivers 23 are formed at an interval in the lengthwise direction on the top portion 21. At one end of the two sides portions 22, shaft holes 24 which align with the shaft holes 16 are respectively provided. Between the pair of nib receivers 23 on the top portion 21, an engagement projection 25 is provided so as to project downward and is designed to fix one end of the metal spring member 3 to the lever member 2. At the end opposite to the shaft holes 24 side of the top portion 21, that is, at the free end side, an engagement projection 26 is formed which serves as an engagement means for engaging with the engagement portion 19 of the mount 1, and which is removed from the engagement portion 19 by a slight sideways shifting of the free end of the lever member 2.

The metal spring member 3 includes a central coil portion 31, an engagement end 32 of linear shape which is one end portion of the coil portion 31 and which engages with the engagement projection 25 of the lever member 2, and a retention end portion 33 which is the other end of the coil portion 31 and which rotatably retains the pressing means 4. The engagement end portion 32 and the retention end portion are elastically urged by the coil portion 31 in the directions opposite to each other. The axial length of the coil portion 31 is slightly shorter than the width or distance between the two side portions 22 of the lever member 2. The retention end portion 33 is bent outward from its middle at an angle of approximate 45°. With regard to the metal spring member 3, after the coil portion 31 is positioned between the bearing projections 15 so that its openings align with the shaft holes 16 of the bearing projections 15, it is secured to the mount 1 by passing a shaft 34 which has an axial length approximately equal to the distance between the bearing projections 15 through the openings of the coil portion 31 from one of the shaft holes 16.

Figure 3:
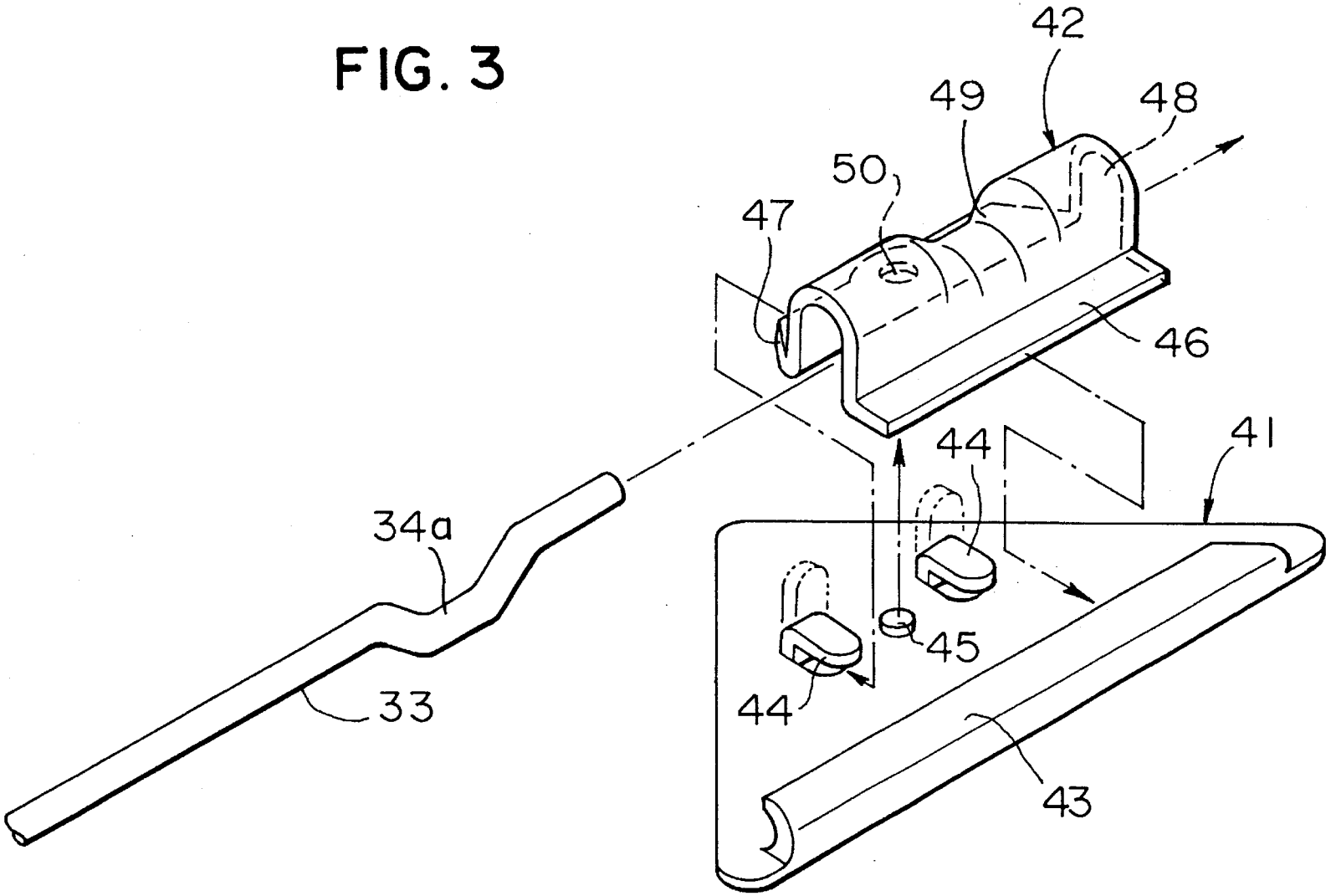
FIG. 3 is a perspective view which shows the pressing means in a disassembled and enlarged state.
Figure 4:
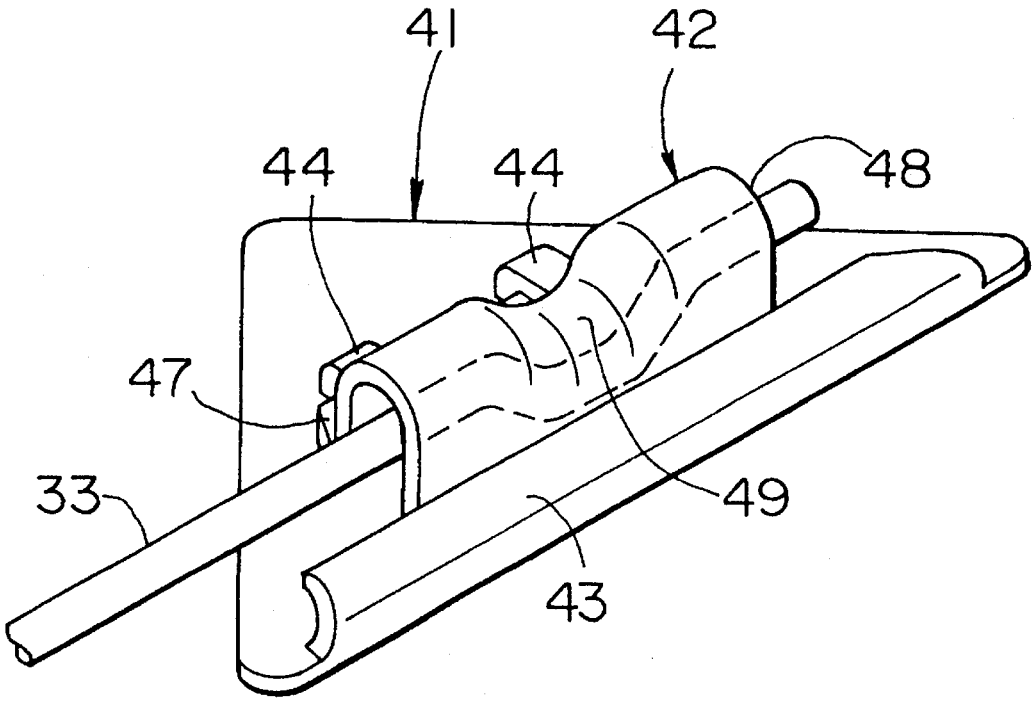
FIG. 4 is a perspective view which shows the pressing means in an assembled and enlarged state.
Figure 5:
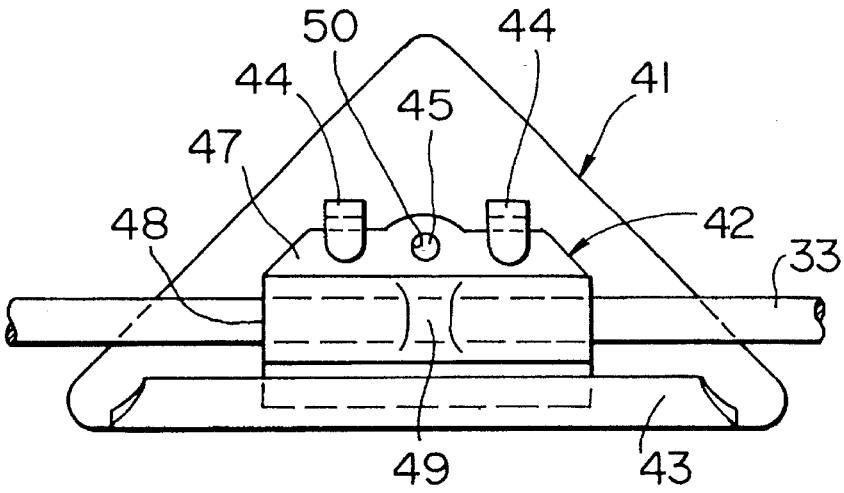
FIG. 5 is a plan view which shows an enlargement of the pressing means.
Figure 6:
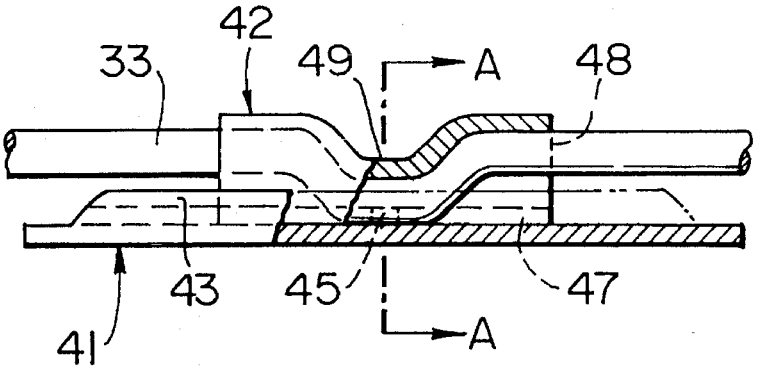
FIG. 6 is an enlarged side view which shows the pressing means in a partially segmented state.

As shown in detail in the drawings from FIG. 3 to FIG. 7, the pressing means 4 made from metal plate includes a pressing plate member 41 which has the shape of an approximate right triangle, and a fixed plate member 42 which is fixed to the top of the pressing plate member 41 and which rotatably supports the retention end portion 33 of the metal spring member 3 together with the pressing plate member 41. The pressing plate member 41 and the fixed plate member 42 are both made from metallic plate material. With regard to the pressing plate member 41, an insertion groove 43 is formed in the surface of the pressing plate member 41 by bending back a portion of the side which faces opposite to its right angled summit, and a pair of claws 44 are formed by cut-out on the right angled summit side which lies opposite to the insertion groove 43. Between the pair of claws 44, a positioning protrusion 45 which projects upward is formed by embossing or the like. On the fixed plate member 42, there are formed a flat first skirt portion 46 which inserts into the insertion groove 43, a second skirt portion 47 which is also flat and which is attached to the surface of the pressing plate member 41 by the claws 44, and an insertion portion 48 of approximately semi-cylindrical shape which is positioned between these first and second skirt portions 46 and 47, and which is designed to allow passage of the retention end portion 33 of the metal spring member 3. The height of the insertion portion 48 is set to be higher than the diameter of the retention end portion 33 of the metal spring member 3, and a constricted portion 49 which falls downward is formed at the center of its axial length. With regard to the constricted portion 49, as shown in FIG. 3, if the fixed plate member 42 is fixed to the pressing plate member 41 in the state in which a step portion **34*a* formed in the retention end portion 33 of the metal spring member 3 is positioned at the constricted portion 49, the retention end portion 33 can be rotatably retained without any dislodgement of the retention end portion 33 from the insertion portion 48. A positioning hole 50 is pierced in the second skirt portion 47 into which the positioning protrusion 45 is inserted for purposes of determining the position of the fixed plate member 42**.

The cover member 5 is made of synthetic resin, and is provided with an upper plate 51 and a circumferential face 52 which is formed integrally with the upper plate 51 so as to extend downward from the periphery of the upper plate 51 so that the cover member 5 covers the lever member 2 and the bearing projections 15 from above. On the underside of the upper plate 51, nibs 53 are provided so as to project downward to be inserted into the nib receivers 23 for purposes of fixing the cover member 5 to the lever member 2.

Figure 7:
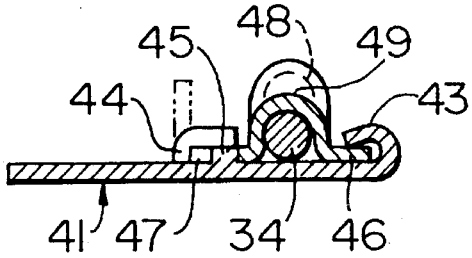
FIG. 7 is a vertical sectional view which shows the segment along the A—A line of FIG. 6.

Next, the assembly of the paper binder will be explained. First, the pressing means 4 is secured to the retention end portion 33 of the metal spring member 3. This is done by raising in advance the pair of claws 44 provided on the pressing plate member 41 of the pressing means 4 as shown in FIGS. 3 and 7, and, first, inserting the first skirt portion 46 of the fixed plate member 42 into the insertion groove 43 of the pressing plate member 41. Next, the retention end portion 33 of the metal spring member 3 is passed through the insertion portion 48 of the fixed plate member 42, the positioning protrusion 45 is inserted into the positioning hole 50 in the state where the step portion **34*a* is positioned in the constricted portion 49, and the position of the fixed plate member 42 relative to the pressing plate member 41 is fixed, after which the pair of claws 44 are bent back and the second skirt portion 47 side of the fixed plate member 42 is fixed in place. After the pressing means 4 has been secured in the metal spring member 3 in this way, the coil portion 31 of the metal spring member 3 and the end of the lever member 2 at the shaft hole 24 side are positioned between the bearing projections 15, and after the openings of the coil portion 31 and the shaft holes 16 of the bearing projections 15 are positioned in alignment, the shaft 35 is made to pass through from one of the shaft holes 16 of the bearing projections 15. By this means, the lever member 2 and the metal spring member 3 are secured to the mount 1. Next, the engagement end 32 of the metal spring member 3 is engaged in the engagement projection 25 of the lever member 2. Finally, the cover member 5 is fit on so that it covers the lever member 2 and the bearing projections 15 from above. By this means, the nibs 53 of the cover member 5 are inserted into the nib receivers 23 of the lever member 2**, and the two are firmly fixed together. In this way, assembly can be effected by a simple process.

In the case where paper 6 such as slips are bound in this paper binder (see FIG. 2), the free end of the lever member 2 is shifted slightly to the side while pushing it, so that the engagement projection 26 is removed from the engagement portion 19 of the mount 1. By this means, the free end side of the lever member 2 is raised by the metal spring member 3, and the pressing means 4 also separates from the mount 1. Here, the left end of the paper 6 is matched to the guide projection 18, and is positioned so that the pressing plate member 41 presses down on the corner of the paper 6 when the pressing means 4 is lowered. The free end of the lever member 2 is then lowered, the engagement projection 26 of the lever member 2 engages with the engagement portion 19 of the mount 1, and the free end of the lever member 2 is secured in the lowered state. As a result, since the pressing means 4 is elastically pressed down on the mount 1, the corner of the paper 6 is firmly gripped between the pressing means 4 and mount 1. Since it is the normally blank corner portion of the paper 6 which is pressed, the pressing means 4 does not cover any of the contents recorded on the paper 6. Since the pressing plate member 41 of the pressing means 4 contacts the narrow portion at the corner of the paper 6, even if the paper 6 is bent back from this portion, the bounce of the paper 6 generated by this bending is weak, and even if a large number of pages of the paper 6 are opened by bending them from their corner, the overall bounce does not become large. Consequently, even if a large number of pages of the paper 6 are gripped and leafed through, the paper can be securely gripped without any dislodgement from between the pressing plate member 41 and the mount 1.

Figure 8:
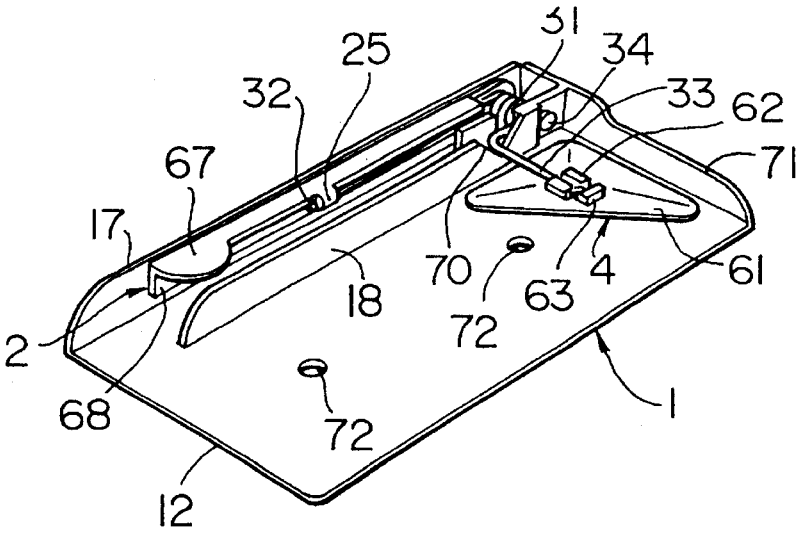
FIG. 8 is a perspective view which shows a second embodiment of the paper binder according to the present invention.
Figure 9:
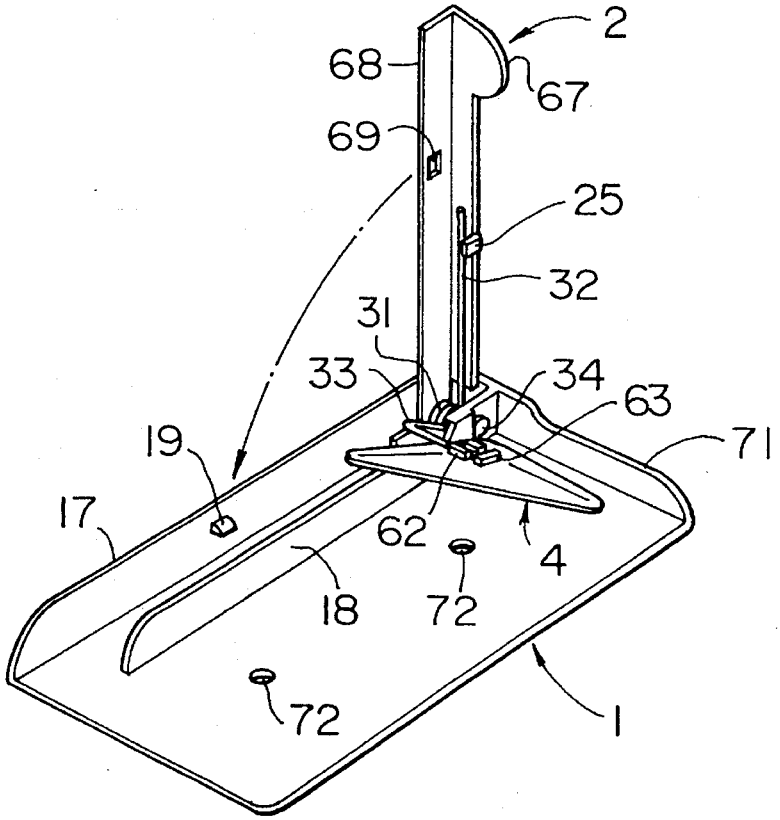
FIG. 9 is a perspective view which shows the second embodiment in the state where the handle is raised.
Figure 10:
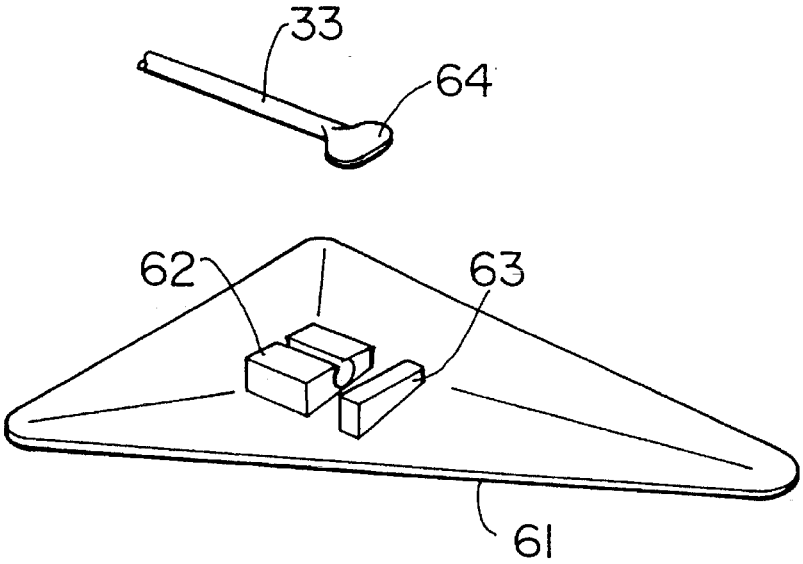
FIG. 10 is a perspective view which shows in a disassembled state the pressing means of the second embodiment.
Figure 11:
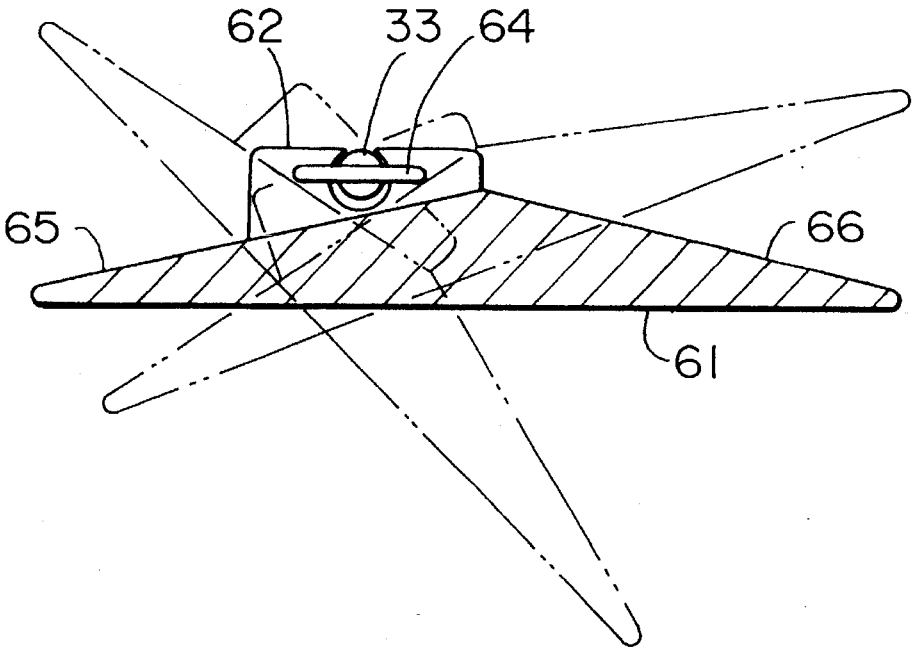
FIG. 11 is a sectional view which shows the rotated state of the pressing means.

Next, a second embodiment shown in the drawings from FIG. 8 to FIG. 11 will be explained. In this second embodiment, the pressing means 4 is made from synthetic resin, and the pair of guide projections 17 and 18 are made to serve also as the bearing projections which were separately provided in the first embodiment. That is, the pressing means 4 is composed from a pressing plate member 61 shaped like an approximate right triangle. As shown in detail in FIG. 10, a groove projection 62 having a groove in which the retention end portion 33 of the metal spring member 3 can be rotatably press fitted, and a stopper projection 63 for regulating the movement of the end of the retention end portion 33 are formed on the top of the pressing plate member 61. A stopper 64 is formed at the tip of the retention end portion 33. The stopper 64 is a flat piece with a width that is longer than the groove width of the groove projection 62. By means of the stopper 64, the retention end portion 33 is prevented from falling out of the groove projection 62 in the direction which lies opposite to the stopper projection 63. With regard to the stopper 64, as shown in FIG. 11, when the free end of the lever member 2 is raised and the pressing plate member 61 is freed, the stopper 64 contacts an inclined faces 65 and 66 of the pressing plate member 61, and prevents any inclination beyond what is required. By this means, as shown in FIG. 9, even if the free end of the lever member 2 is raised, the side positioned at the upper end side of the pressing plate member 61 is lowered, and there is no impediment to the insertion of the paper from the direction of the lower end 12 of the mount 1.

Furthermore, in this second embodiment, there is only the lever member 2 without the cover member 5. The lever member 2 includes a top portion 67, and a side face portion 68 which is bent downward from one side of the top portion 67 and which faces opposite the guide projection 17. The engagement portion 19 is provided on the inner face of the guide projection 17, and as a result of the engagement of the engagement portion 19 in an engagement hole 69 which is pierced in the side face portion 68 of the lever member 2, the free end of the lever member 2 is secured in the lowered state. When releasing the engagement, as shown in FIG. 8 and FIG. 9, the engagement portion 19 is disengaged from the engagement hole 69 by slightly shifting the free end of the lever member 2 toward the right. A convex portion 70 designed to allow passage of the retention end portion 33 of the metal spring member 3 is formed in the guide projection 18, and the shaft 35 is supported at the tips of the guide projections 17 and 18. The portion of the mount 1 positioned on the right side of the guide projection 18 is shorter than in the first embodiment, and a guide projection 71 is formed integrally therewith at the upper end of the mount 1 so as to project upward and guide the top side of the paper. The reference numeral number 72 in the mount 1 designates screw holes.

Figure 12:
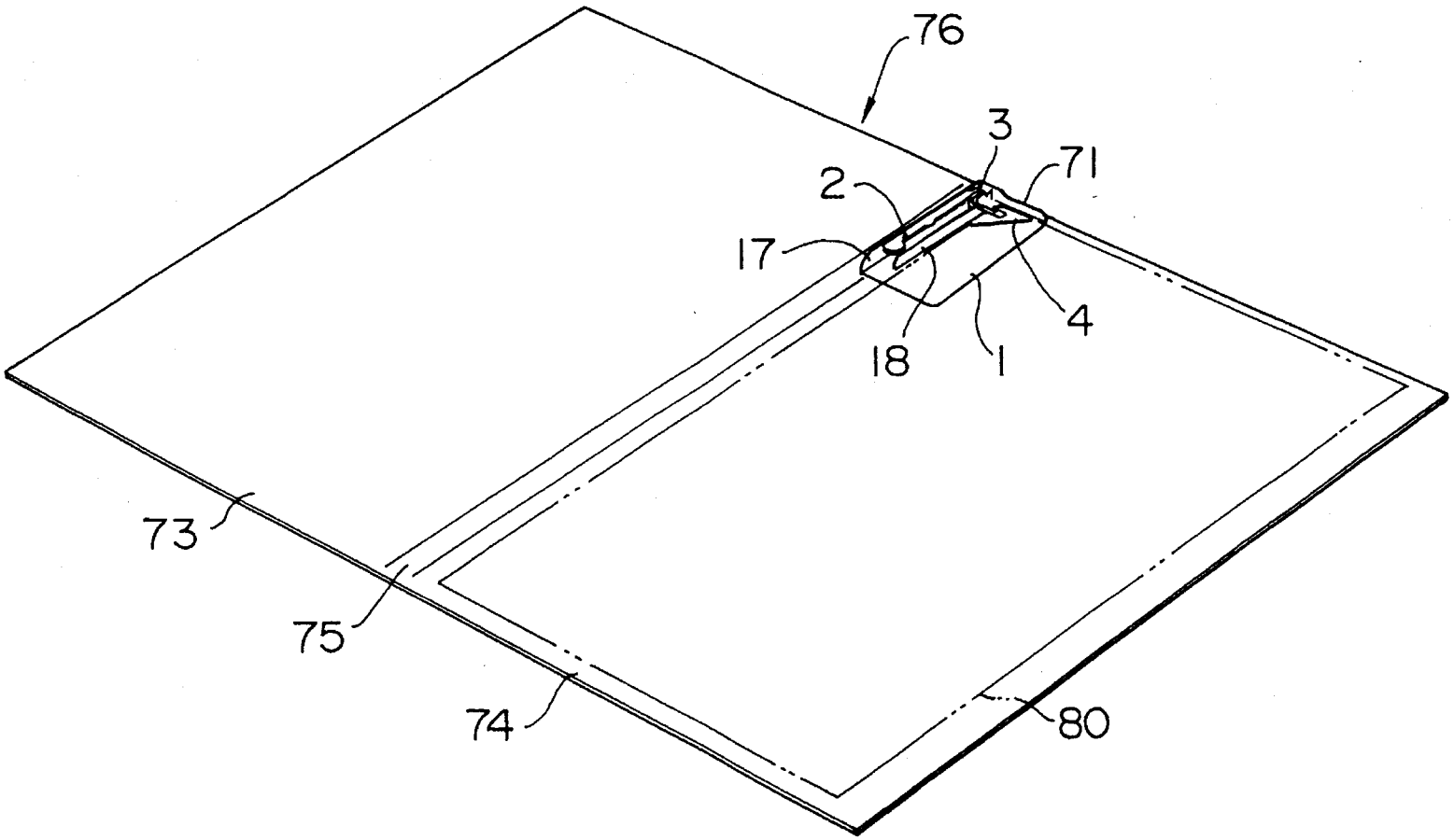
FIG. 12 is a perspective view which shows the second embodiment in the state where the binder is attached to a holder.

As shown in FIG. 12, the paper binder of this second embodiment is attached to a file holder 76 consisting of a front cover 73, a rear cover 74, and a back cover 75. That is, the paper binder is fixed by screws (not illustrated) to the back cover 75 from the screw holes 72 of the mount 1 so that the guide projection 17 of the mount 1 is positioned at the left shoulder of the rear cover 74 along the borderline with the back cover 75, or it is fixed by the adhesion of the rear face of the mount 1 to the back cover 75. By this means, as mentioned above, since one can grip the blank corner portion, not of comparatively small paper such as slips, but of paper 80 such as documents, literature, or the like, of B5 and A4 size and above, it is possible to offer a binder where leafing is made easy and where the leafed pages do not fall back when one releases one's hand from them.

Figure 13:
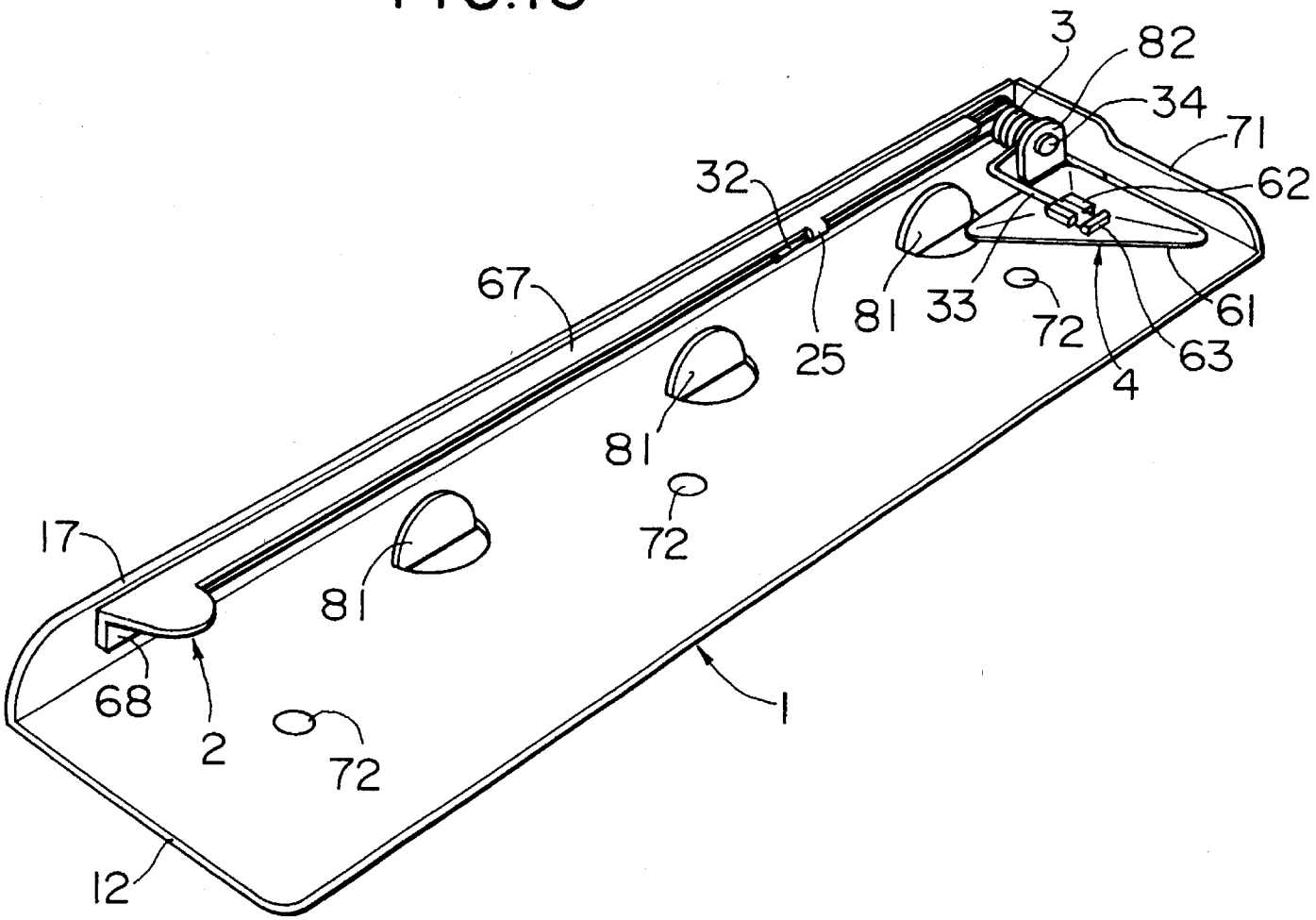
FIG. 13 is a perspective view which shows a third embodiment of the paper binder according to the present invention.

In the aforementioned first and second embodiments, the mount 1 is made from synthetic resin, but in a third embodiment shown in FIG. 13, the mount 1 is made from metal plate material, the lever member 2 is made longer, and the lever member 2 can be lowered by a light force. That is, in FIG. 13, the guide projection 17 is formed by bending back the left side edge of the mount 1, and a guide projection 71 is formed by bending back the top side edge of the mount 1. As members corresponding to the guide projection 18 which grips the lever member 2 of the mount 1 and which is positioned on the opposite side, three guide projections 81 are cut out from the mount 1 at predetermined intervals, and take shape by being raised up. With regard to the shaft 35 which supports the lever member 2 and the metal spring member 3, one end is supported by the guide projection 17, and the other end is supported by a bearing projection 82 which is cut out of the mount 1 and raised up in the same manner as the guide projections 81. What enables the lever member 2 to be lowered by a light force is that the metal spring member 3 of strong elasticity can be used, which imparts a correspondingly strong pressing force to the pressing means 4. Consequently, a binder can be offered which is able to bind a larger number of pages than in the case of either the first or second embodiment, and one can also bind large paper of B4 or A3 size by attaching the paper binder to a file holder.

In the case where the paper binder is attached to a file holder made from flexible material, it is necessary to make the length of the lever member 2 shorter than the length of the mount 1 which is positioned underneath it. This is because, if the lever member 2 is longer than the mount 1, when force is imparted to the free end of the lever member 2 and it is lowered, the shaft 35 side is raised, and it is possible that the binder might break from the lower end portion 12 of the mount 1.

In each of the aforementioned embodiments, a lever member 2 is provided at the left end of the mount 1, and the pressing means 4 is positioned at the right side of the lever member 2, but in the case of righthand binding of the paper, the lever member 2 may be provided at the right end of the mount 1, the pressing means 4 being positioned at the left side of the lever member 2.

In the foregoing, the present invention has been explained with reference to preferable embodiments, and these descriptions have been made in order to facilitate understanding, but the present invention is capable of many variations or modifications so long as no departure is made from the scope of the accompanying claims.

What is claimed is:

1. A paper binder comprising:

a rectangular mount;

a lever means extending in parallel with one edge of said mount and having one end rotatably supported at a corner portion of said mount;

a spring means supported on said mount and having opposite ends one of which is fixed to said lever means so as to urge a free end of said lever means upward elastically;

a pressing means attached to the other one of said opposite ends of said spring means so that said pressing means is elastically pressed in the direction toward said mount by an elastic force of said spring means to thereby grip a corner of paper disposed between said pressing means and said mount when the free end of said lever means is pressed downward against the elastic force of said spring means; and a locking means for locking said lever means when the free end of said lever means is pressed downward to maintain the lowered state of said lever means.

2. A paper binder according to claim 1, wherein a pair of projections are formed on said mount so as to be opposite to two side faces of said lever means.

3. A paper binder according to claim 1, wherein a remainder portion of said mount excepting the portion where said lever means is located has a size larger than the size of the paper to be bound.

4. A paper binder according to claim 1, wherein said lever means has a length which is shorter than the length of said mount in the direction of extension of said lever means.

5. A paper binder according to claim 1, further comprising a cover means for covering a top face and side faces of said lever means.

6. A paper binder according to claim 1, further comprising a regulation means for preventing any greater than necessary rotation of said pressing means when the free end of said lever means is positioned upward and pressure applied to said lever means in the direction toward said mount is released.

7. A paper binder according to claim 1, wherein said pressing means is composed of a pressing plate member and a fixed plate member, said pressing plate member being made from a metal plate so as to form an approximate right triangle, said pressing plate member having claw means which is formed thereon and a grooved engagement portion which is formed by bending backward a part of said pressing plate member at the hypotenuse of said right triangle so as to form a groove on top, said fixed plate member having one end which is inserted into said groove of said engagement portion of said pressing plate member and having the other end which is fixed to said pressing plate member by said claw means, said other end of said spring means being rotatably supported between said fixed plate member and said pressing plate member.

8. A paper binder according to claim 1, wherein said pressing means is made from synthetic resin so as to form an approximate right triangle, said pressing means having a groove formed on its top face so as to rotatably support the other end of said spring member in said groove.

9. A paper binder according to claim 1, wherein said lock means includes a projection provided in a rear face of the free end side of said lever means and an engagement portion which is provided on said mount so as to engage with said projection to thereby regulate raising of said lever means when said lever member is pushed downward.

* * * * *